US011312173B2

(12) United States Patent
Golovata

(10) Patent No.: US 11,312,173 B2
(45) Date of Patent: Apr. 26, 2022

(54) MULTI-PURPOSE THREE-DIMENSIONAL PUZZLE SYSTEM

(71) Applicant: Ganna Golovata, Hanover, MD (US)

(72) Inventor: Ganna Golovata, Hanover, MD (US)

( * ) Notice: Subject to any disclaimer, the term of this patent is extended or adjusted under 35 U.S.C. 154(b) by 0 days.

(21) Appl. No.: 16/694,753

(22) Filed: Nov. 25, 2019

(65) Prior Publication Data

US 2020/0230994 A1 Jul. 23, 2020

Related U.S. Application Data

(60) Provisional application No. 62/771,549, filed on Nov. 26, 2018.

(51) Int. Cl.
*A63F 9/10* (2006.01)
*B42D 15/04* (2006.01)

(52) U.S. Cl.
CPC ..... *B42D 15/045* (2013.01); *A63F 9/1044* (2013.01)

(58) Field of Classification Search
CPC ..... A63F 9/1044; A63F 2009/0049; A63F 2009/0047; A63F 9/0666; B42D 15/045
See application file for complete search history.

(56) References Cited

U.S. PATENT DOCUMENTS

D26,529 S * 1/1897 Way ..... D21/470
1,125,423 A * 1/1915 Wiley ..... A63F 9/06 434/96
3,422,563 A * 1/1969 Kiley ..... A63F 9/10 446/118
3,491,196 A * 1/1970 Stein ..... A63F 9/0098 434/345

(Continued)

FOREIGN PATENT DOCUMENTS

CA 2231704 A1 * 9/1999

OTHER PUBLICATIONS

Merriam Webster, definition of "Key Fob", retrieved on Oct. 20, 2020. (Year: 2020).*

*Primary Examiner* — Steven B Wong
(74) *Attorney, Agent, or Firm* — Allen F. Bennett; Bennett Intellectual Property

(57) ABSTRACT

The present invention relates to a multi-purpose pairable puzzle system with hanging 3-dimensional puzzle element 100. In the preferred embodiment 100, the system includes a three-dimensional wooden board 146 with a shape or a plurality of shapes 144 cut through and then separated, thus forming a hole through the board 128 having a defined shape 148 through which the complementary three-dimensional shape 102 that was cut out and separated can be fitted to form a completed puzzle. The removable complementary three-dimensional shape 102 will have a small opening 124*a*, at the top surface through which a ribbon 124 is inserted for the purpose of hanging the removable three-dimensional shape 102. In another embodiment, the entire rear surface 108 of the wooden board 146 will have a paper element 220 fitted. The paper element will have slit lines 216 shaped as the removable wooden three-dimensional element 102 with small attachment points 208 to retain the shape created 212 with the rest of the paper until punched out by the user. When punched out the paper retain the same shape as the removable three-dimensional wooden puzzle element 102.

8 Claims, 18 Drawing Sheets

(56) References Cited

U.S. PATENT DOCUMENTS

| | | | | | |
|---|---|---|---|---|---|
| 4,258,920 | A * | 3/1981 | Waldron | A63F 9/10 | 273/157 R |
| 4,424,637 | A * | 1/1984 | Leahy | G09F 1/12 | 40/735 |
| 4,462,176 | A * | 7/1984 | Schovee | A47G 1/06 | 40/700 |
| 4,487,585 | A * | 12/1984 | Goldwasser | A63F 9/10 | 273/156 |
| 4,489,512 | A * | 12/1984 | Schovee | A47G 1/06 | 156/73.1 |
| 4,899,473 | A * | 2/1990 | Wiener | A47G 1/06 | 40/735 |
| 5,383,293 | A * | 1/1995 | Royal | A47G 1/0616 | 40/768 |
| D425,117 | S * | 5/2000 | Saito | D19/40 | |
| 6,265,035 | B1 * | 7/2001 | Sniderman | A47G 33/08 | 156/250 |
| 6,485,801 | B1 * | 11/2002 | Chen | G09F 19/02 | 40/617 |
| 6,626,678 | B2 * | 9/2003 | Forbes | A63F 9/0666 | 273/153 R |
| 9,272,062 | B1 * | 3/2016 | Heflin, III | A61L 9/12 | |
| 2005/0200076 | A1 * | 9/2005 | Wu | A63F 9/10 | 273/157 R |
| 2007/0164513 | A1 * | 7/2007 | Gelman | A63F 9/10 | 273/157 R |
| 2010/0083548 | A1 * | 4/2010 | Reis | A47G 1/142 | 40/711 |
| 2015/0209661 | A1 * | 7/2015 | Klemm | G09B 23/02 | 273/157 R |
| 2016/0213186 | A1 * | 7/2016 | Rezny | B43L 1/00 | |
| 2019/0247743 | A1 * | 8/2019 | Moon | A63H 9/00 | |

* cited by examiner

MULTI-PURPOSE THREE-DIMENSIONAL PUZZLE SYSTEM

I. TECHNICAL FIELD OF THE INVENTION

The subject invention relates to a greeting card or greeting gift system that is designed in the form of a three-dimensional puzzle system consisting of two or more pieces. The removable element of the puzzle system including its base are designed to be used for various functions and will serve as a system for giving a memento or other physical objects to convey and especially express a message while preserving a memory.

II. BACKGROUND OF THE INVENTION

There are a variety of designs for greeting cards on today's market. In addition to having the greeting card convey an appropriate message, today's cards attempt to capture attention by means of their design or their ability to entertain. Since greeting cards are generally made from paper material, many greeting cards fills this need by combining their greeting cards with some commemorative item such as a gift, audio, an ornament or jewelry. The memento item is usually either separated from the gift card or may be attach as part of the card. While there are many ways to combine greeting cards with keepsake items, none of them have been designed as a full combination puzzle system. Also, many greeting cards are design to be separated once and serve only one purpose which may bored the user in time. Further, some greeting gift systems are a combination of two unrelatable elements, one of which may be of higher value than the other, which may draw away from the message that is presented.

It is therefore desirable to improve the gift card design by creating a greeting gift system that can also be used for multiple other purposes. The various elements that will be a part of said greeting gift system should be separable yet pairable, transformable but equally valuable.

III. SUMMARY OF THE INVENTION

The present invention relates to a multi-purpose pairable puzzle system with hanging three-dimensional puzzle element or a plurality of elements. In the preferred embodiment, the system includes a three-dimensional wooden board with a shape or a plurality of shapes cut through and then separated, thus leaving an opening through the base board having a defined shape through which the complementary three-dimensional shape that was cut out and separated can be fitted to form a completed puzzle. The removable complementary three-dimensional shape will have a small opening, at the top surface through which a ribbon is inserted for the purpose of hanging the removable three-dimensional shape. In another embodiment, the entire rear surface of the wooden board will have a paper element laminated. The paper element will have slit lines shaped as the removable wooden three-dimensional element with small attachment points to retain the shape created with the rest of the paper until punched out by the user. The slit line shape will be in the same position as the wooden shape line so that when punched out, the paper will retain the same shape as the removable three-dimensional wooden puzzle element.

IV. BRIEF DESCRIPTION OF THE DRAWINGS

So that those having ordinary skill in the art to which the present invention pertains will more readily understand how to employ the systems and methods of the present invention, embodiments thereof will be described in detail below with reference to the drawings, wherein.

DETAILED DESCRIPTION OF THE PREFERRED EMBODIMENTS

Disclosed herein are detailed descriptions of specific embodiments of a multi-purpose three-dimensional puzzle system, methods and package assemblies of the present inventions. It is understood that the disclosed embodiments are merely examples of the way in which certain aspects of the invention can be implemented and do not represent and exhaustive list of all the ways the invention may be embodied. Indeed, it will be understood that the systems, devices, methods and package assemblies described herein may be embodied in various and alternative forms.

The figures are not necessarily to scale, and some features may be exaggerated or minimized to show details of particular components. Well-known components, materials or methods are not necessarily described in great detail in order to avoid obscuring the present disclosure. Any specific structural and functional details disclosed herein are not to be interpreted as limiting, but merely as a basis for the claims, and as a representative basis for teaching one skilled in the art to variously employ the invention. Also, as used herein, the term "comprises" means "includes." Hence "comprising A or B" means including A, or B, or A and B.

Figures 2, 3, 4:
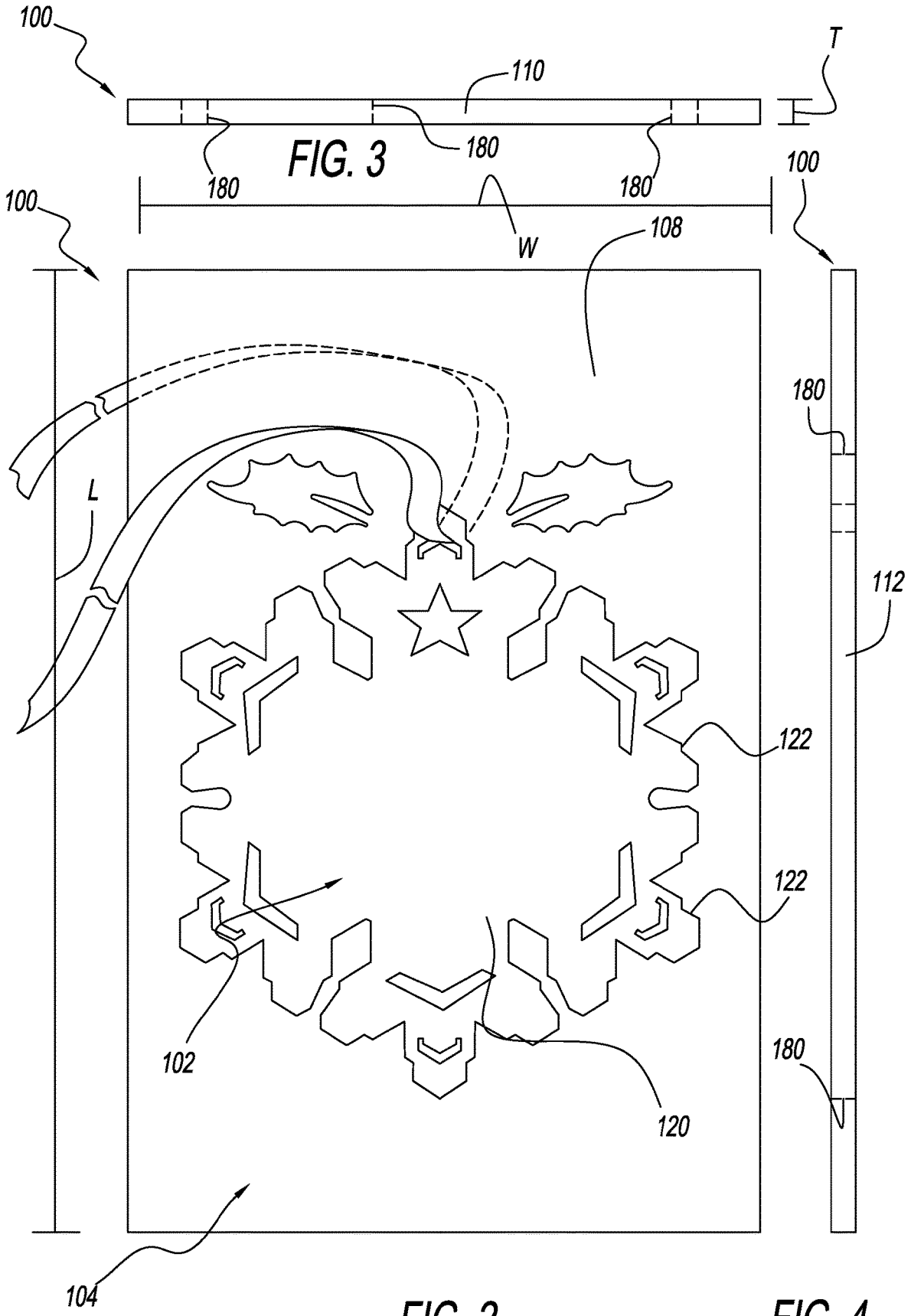
FIG. 2 is a rear view of the preferred embodiment of the multi-purpose three-dimensional puzzle system.
FIG. 3 is a top view of the preferred embodiment of the multi-purpose three-dimensional puzzle system.
FIG. 4 is the right-side view of the preferred embodiment of the multi-purpose three-dimensional puzzle system.

Beginning with FIG. 1 to FIG. 4, FIG. 1 is showing the front view of a multi-purpose pairable puzzle system with hanging three-dimensional puzzle element according to the present invention. FIG. 2 is rear view of the preferred embodiment of the wooden puzzle system. FIG. 3 is a top view of the preferred embodiment of the wooden puzzle system. FIG. 4 is the right-side view of the preferred embodiment of the wooden puzzle system.

In its simplest form the puzzle system 100 of the present invention is made from a wooden board and when shown in plan view, the wooden puzzle system 100 has a length of 6 inches (L), a width of 4 inches (W), and a height or thickness of $1/16^{th}$ or $1/8^{th}$ of an inch (H). However, the puzzle system can be made board of any size.

Figure 1:
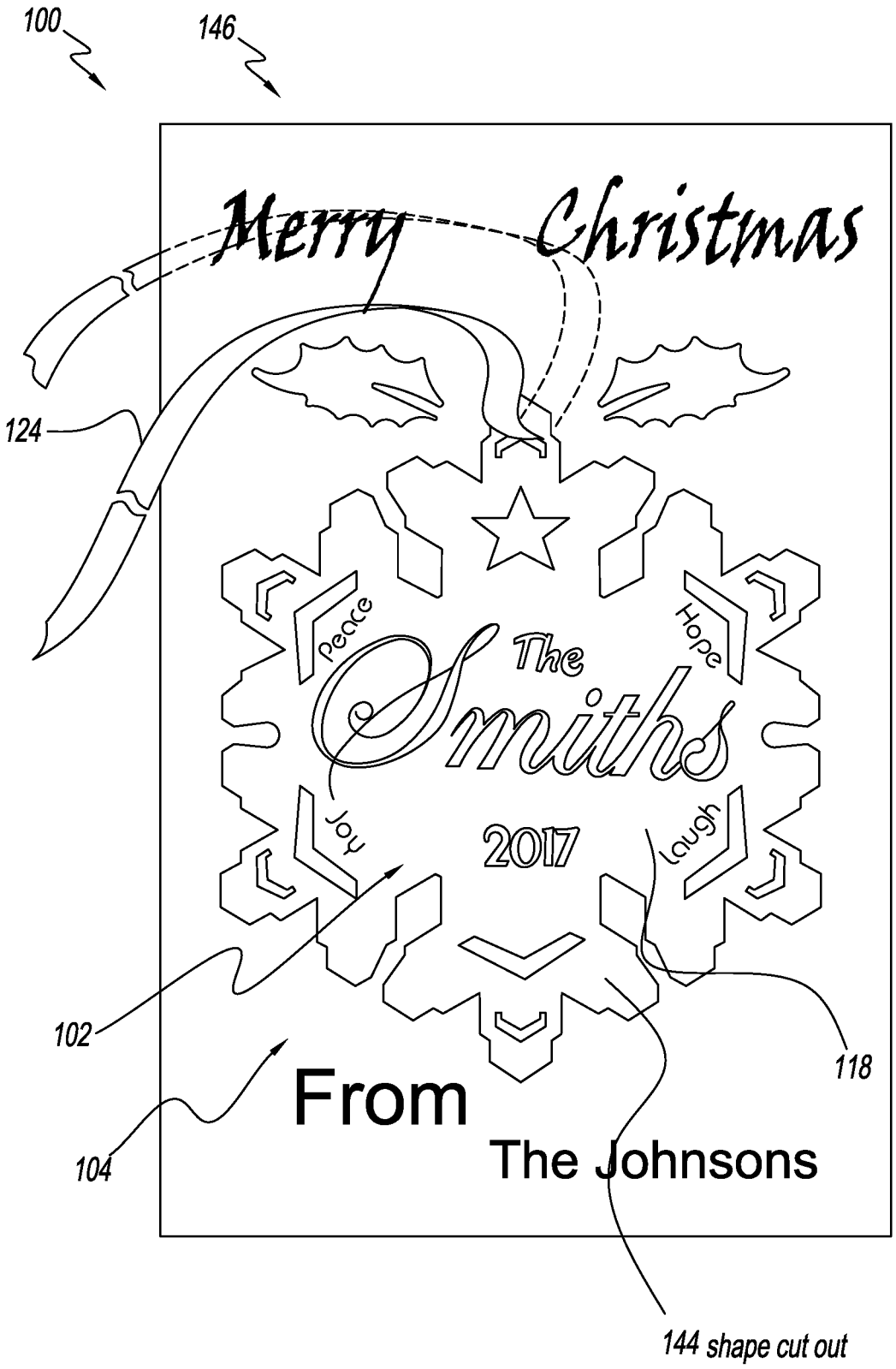
FIG. 1 is a front view of the preferred embodiment of the multi-purpose three-dimensional puzzle system.

Shown also in FIGS. 1 and 2, a shape 144, can be cut through the wooden board 146 via cutline 122. Whatever shape is formed by cutline 122, can be cut out of the wooden board and removed to form a puzzle piece. When the shape is cut out at line 122, it leaves an opening 128 (not shown) that is complementary to the shape that was cut out so that wooden board 146 has a removable piece 144. As shown in FIGS. 1 and 2, the wooden board 146 and the removable shape 144 when combined together will form the multi-purpose pairable puzzle system with removable hanging element 100. When used as a puzzle system 100, the wooden board 146 will serve as the base 104 while the removable shape 144 will form the three-dimensional removable puzzle element 102 as shown and described in FIGS. 1 and 2.

Figure 5:
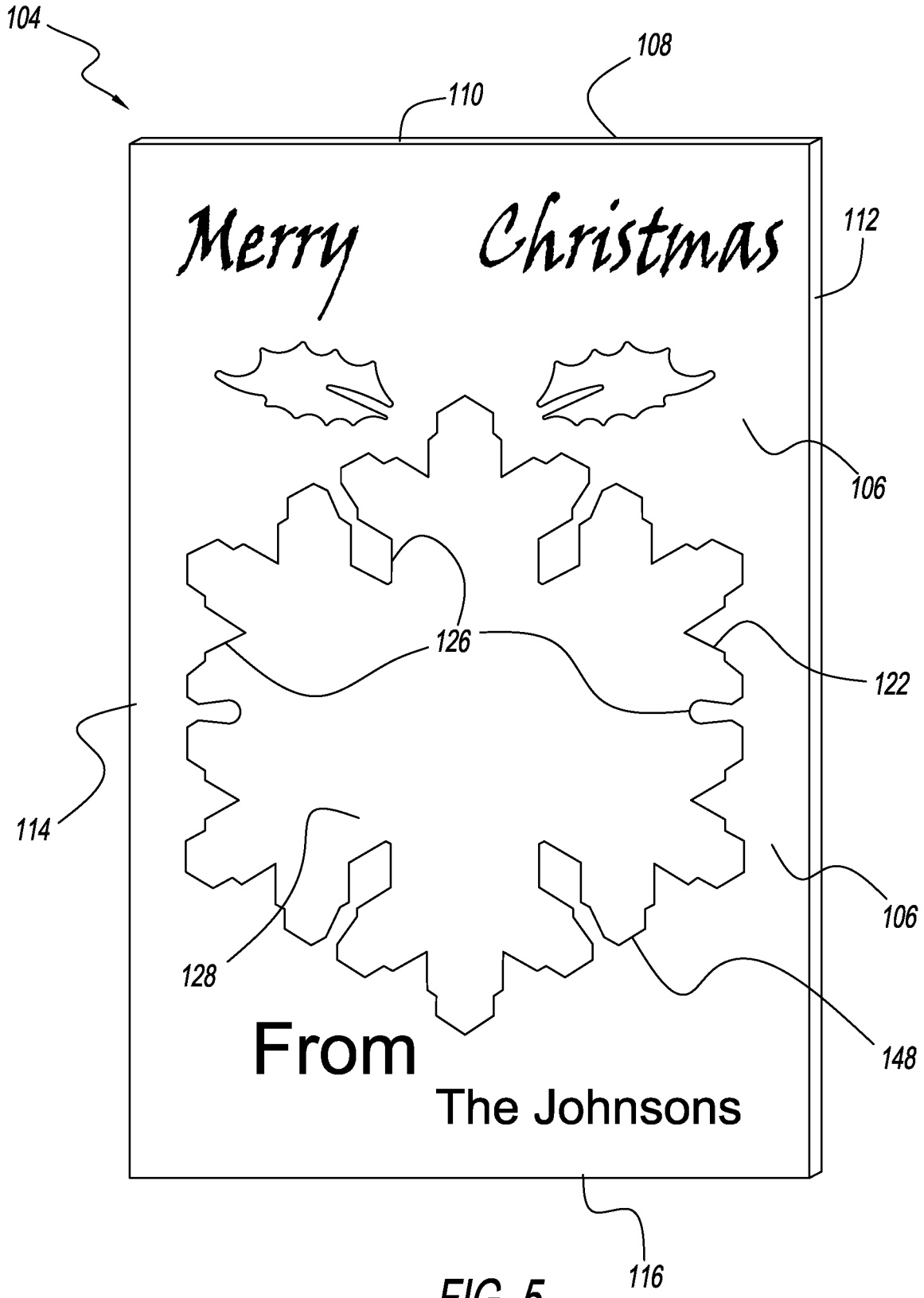
FIG. 5 is a front view of the base puzzle element of the multi-purpose three-dimensional puzzle system with the removable puzzle element detached.
Figure 6:
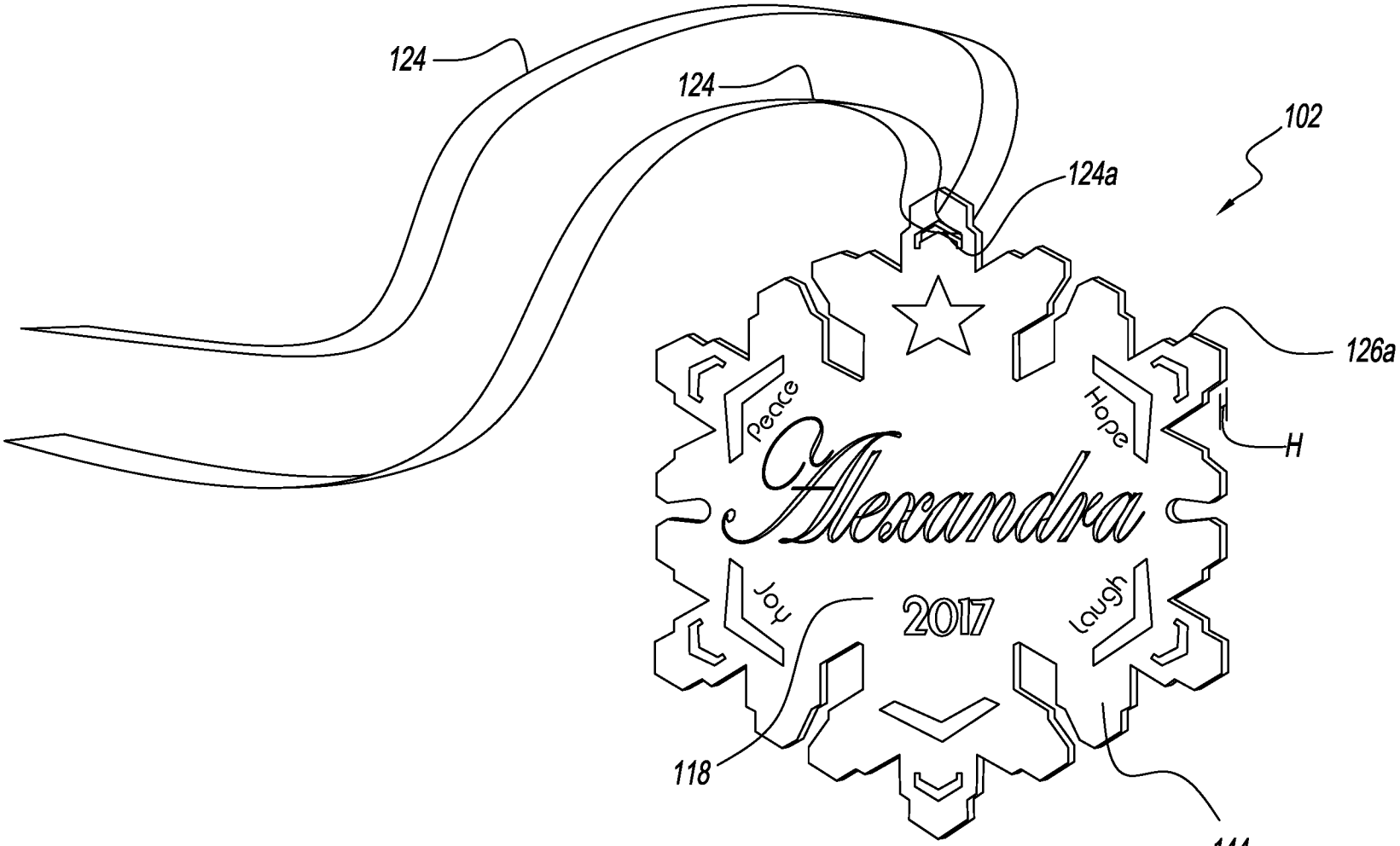
FIG. 6 is a front view of the removable puzzle element of the multi-purpose three-dimensional puzzle system.
Figure 7:
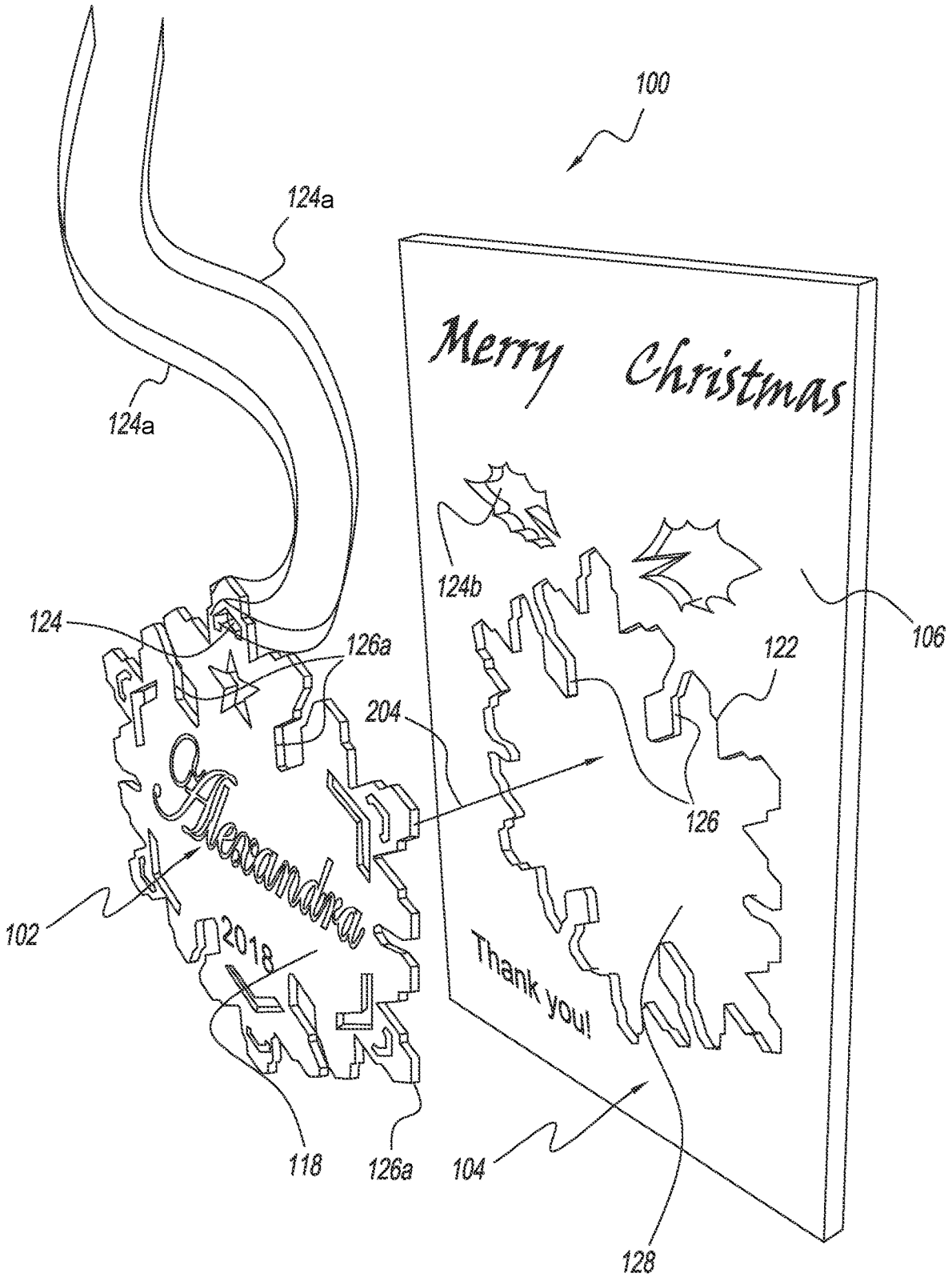
FIG. 7 is an exploded view of the preferred embodiment of the multi-purpose three-dimensional puzzle system.
Figure 8:
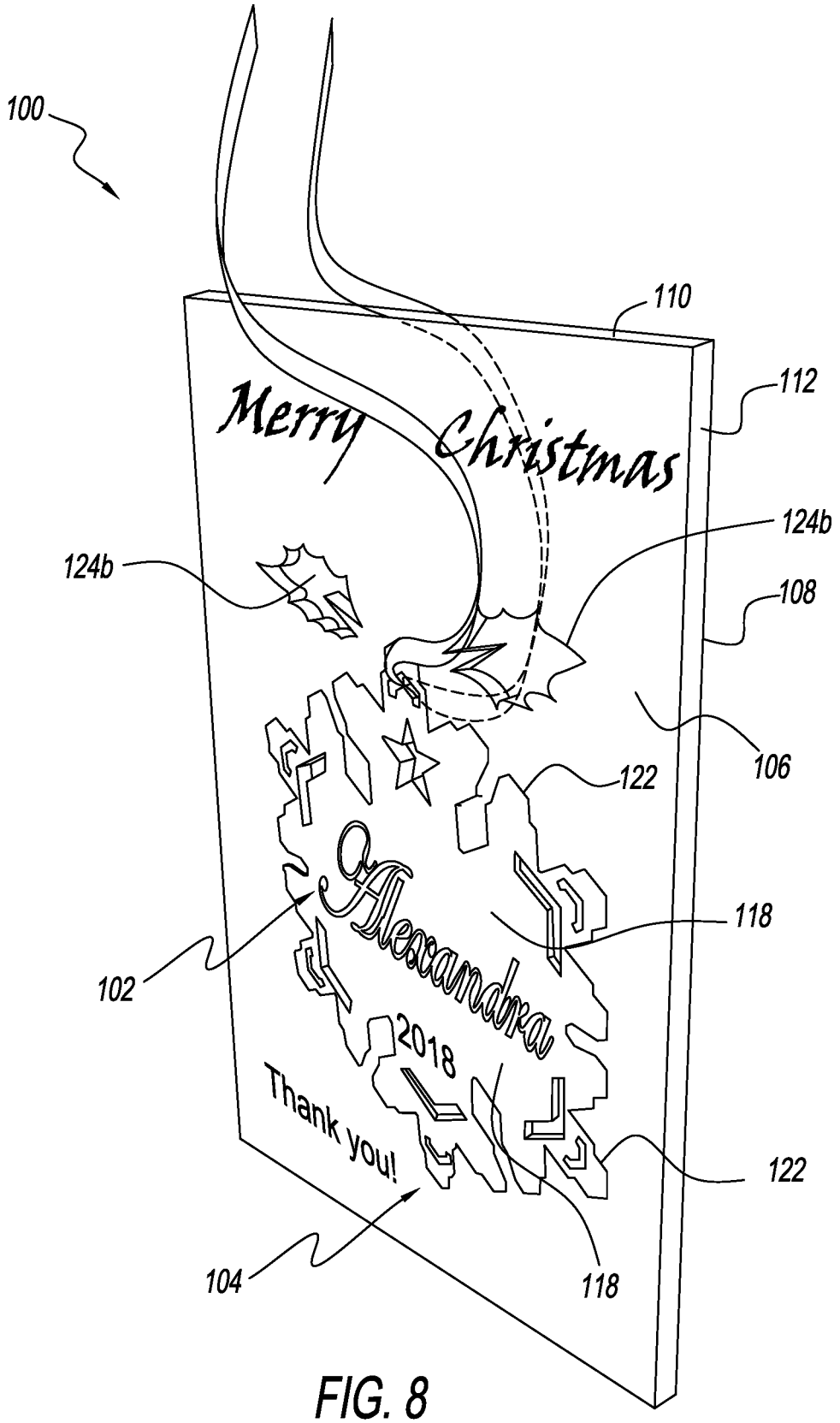
FIG. 8 is a perspective view of the preferred embodiment of the multi-purpose three-dimensional puzzle system fully assembled.
Figure 9:
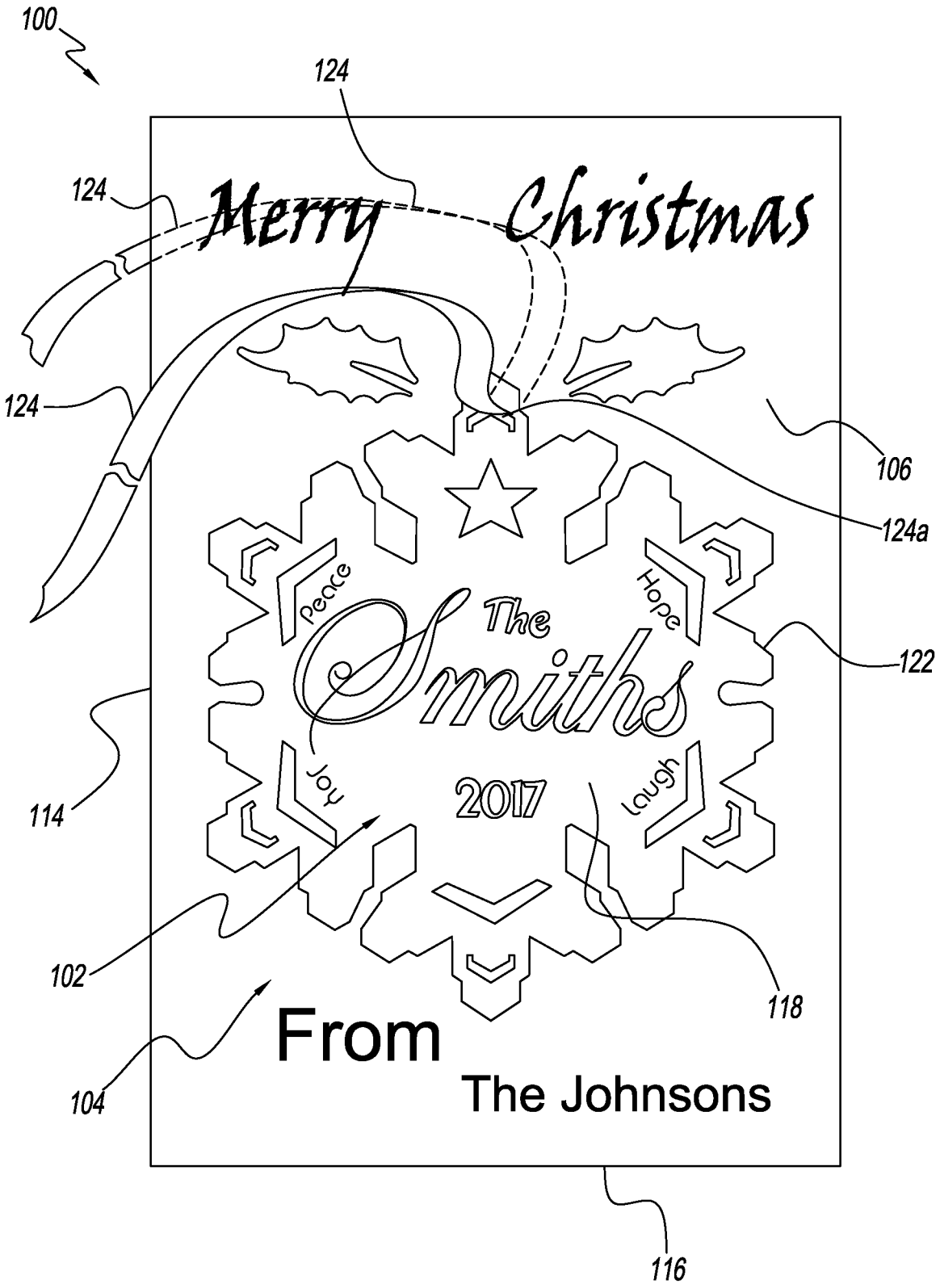
FIG. 9 is a front view of the preferred embodiment of the multi-purpose three-dimensional puzzle system fully assembled.

With attention to FIGS. 5 to 7, we see that FIG. 5 is showing the three-dimensional pairable puzzle base 104, FIG. 6 is showing the front view 118 of the three-dimensional removable puzzle element 102. FIG. 7 is showing the top-right perspective view of the preferred embodiment of the wooden greeting card with removable puzzle element exploded from the base. FIG. 8 is showing the top-right perspective view of both the three-dimensional pairable puzzle base 104, and the complementary removable three-dimensional puzzle element 102 combined. The removable three-dimensional puzzle element 102 is shown fully inserted and fitted into the three-dimensional puzzle base 104 to form the fully assembled puzzle system 100. Finally, FIG. 9 is showing a front view of both the three-dimensional pairable puzzle base 104 and the complementary removable three-dimensional puzzle element 102 combined with the removable three-dimensional puzzle element 102 is shown fully inserted and fitted into the three-dimensional puzzle base 104.

Going back now to FIG. 5. Therein, the wooden puzzle base element 104, is consisting of a front side 106, and a back side 108 which is symmetrical to the front face 106, a top side 110 which can also be seen in FIG. 3, a right side 112, which is seen in FIG. 4, a left side 114, and a bottom side 116. On the front face 106, of the base 104 is an opening 128, along perimeter cutline 122, with slot edges 126, that forms a defined shape 148. The opening 128, goes all the way through the wooden board so that one can fit a finger through the opening 128, or a person can fit the missing puzzle shape 102 that was cut away from the wooden base 104.

Looking closely at FIG. 6 is an illustration of the missing shape 102, that was cut away from wooden board 146 via perimeter cutline 122, as shown in FIG. 5. The removable puzzle element 102, is consisting of at least one-hole 124*a*, through which a ribbon 124, can be inserted for the purpose of hanging the removable three-dimensional puzzle element 102. In one example, the removable three-dimensional puzzle element 102, have edge surfaces the same height or thickness of $1/16^{th}$ or $1/8^{th}$ of an inch (H) as the base since it was cut from the same wooden panel 146, as the puzzle base 104. The three-dimensional puzzle element 102, can be fitted back into the three-dimensional base puzzle element 104, by inserting it into the opening 128, on the base 104 and resting it in place on the surface 126, as shown in FIG. 7. When the three-dimensional is removed, it can serve various other purposes as shown in FIGS. 17 to 21.

Please turn your attention to FIG. 7. As shown from the illustration, the removable puzzle element 102, is shown exploded from the base puzzle element 104. Identified in the illustration is the front face 118, of the removable puzzle element 102, and the front face 106, of the base element 104. Seen also on the removable puzzle element is an opening 124, for inserting the hanging ribbon 124*a*. As shown in the illustration of FIG. 7, the three-dimensional removable puzzle element 102, which is the male element, is shown inserted into the puzzle base element 104, which is the female opening 128. In FIG. 7, element 102 is shown inserted and fitted into the opening 128 of element 104 via direction arrow 204. Notice that the edge surface 126*a*, of the removable puzzle element 102, is the same thickness as edges 126, of the base puzzle element 104. It should be noted that when the removable puzzle element 102 is removed, it can perfectly fit in the opening that is left within the base element 104, however, the hanging element is not limited to the exact shape that was removed. Elements of varied shapes can be placed within the shape. In an example, a small hole could be inserted on the base element or a design like shape 124*b* as shown in FIG. 7 could be used to combine the element or elements of varied shapes.

In FIGS. 8 and 9, the removable puzzle element 102, is shown fully inserted into the opening 128, of the base element 104. When inserted, the front face 118, of the removable puzzle element 102, is shown in the same orientation as the front face 106, of the base puzzle element 104, thus making for a flushed wooden surface forming a single line 122, as shown in FIG. 8 and FIG. 9. When inserted into the base element 104, the edge surface 126*a*, of the removable puzzle element 102, will fit perfectly and be secure within the slot 126, of the base element 104, and will be flushed with the base surface's 104, front face 106, and back face 108. The ribbon 124, used for hanging will be inserted into the opening 124*a*, of the removable puzzle element and when looped into a knot will serve to keep the two puzzle pieces secure and from loss. The ribbon 124 can be made from varied materials such as ribbon, chain, thread, strings lace or anything that be used to hold the removable puzzle piece in place and for hanging.

Figure 10:
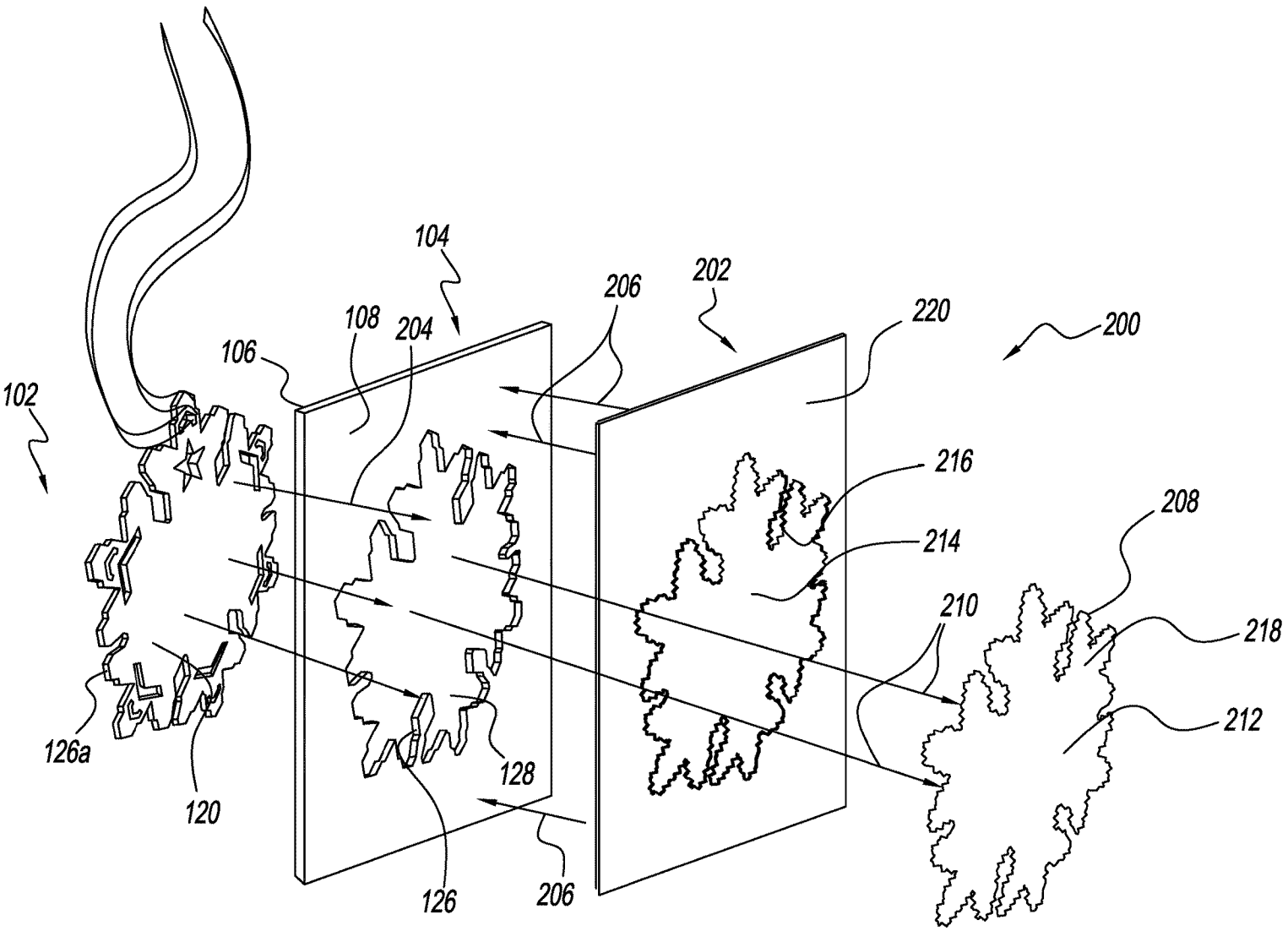
FIG. 10 is a perspective exploded view of the second embodiment of the multi-purpose three-dimensional puzzle system.
Figure 12:
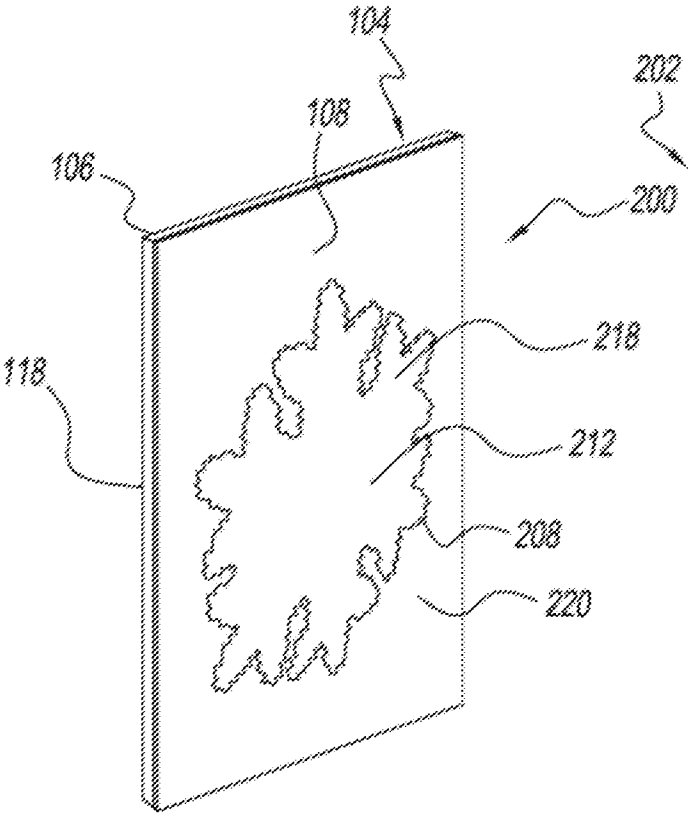
FIG. 12 is a front right perspective view of the second embodiment of the multi-purpose three-dimensional puzzle system partially assembled.
Figure 11:
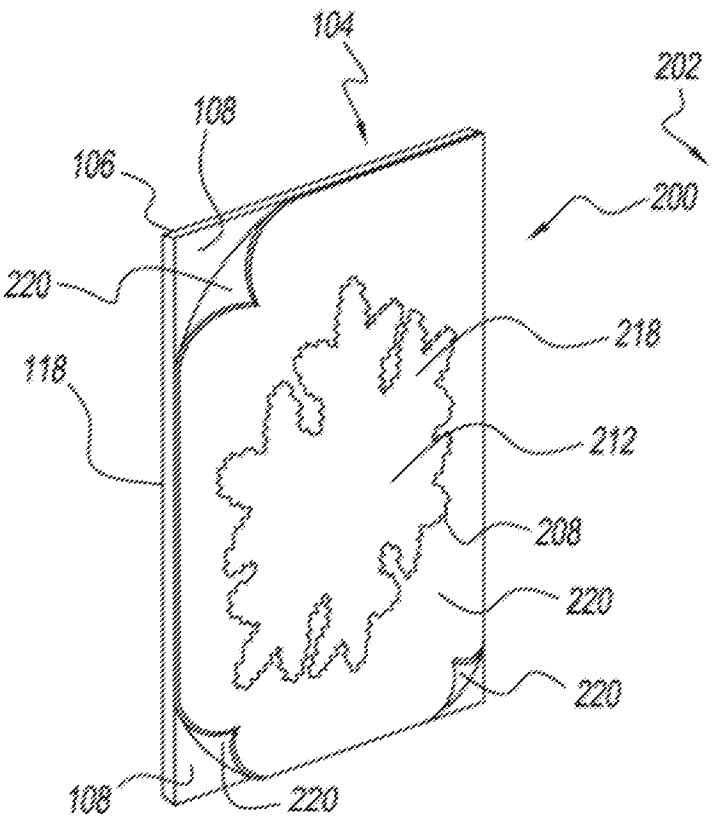
FIG. 11 is a front right perspective view of the second embodiment of the multi-purpose three-dimensional puzzle system partially assembled.

FIG. 10 is a fully exploded rear view of the second embodiment of the pairable three-dimensional puzzle system. FIG. 11 is a perspective view of the second embodiment 200, of the wooden greeting card system with removable puzzle element partially assembled while FIG. 12 is showing the laminated paper element fully lined up and pasted on the card. Taking a closer look at FIG. 10, we see the removable three-dimensional puzzle element 102, the puzzle element base 104, and the ribbon 124, inserted into the opening 124*a*, on the removable puzzle element 102. Identified also in FIG. 10 is the base element liner paper 202, and the removable paper shape 212.

To assemble the second embodiment, the user will first insert the removable puzzle element 102, into the opening 128, that is on the front 106, and through toward the back side 108, of the pairable puzzle base element 104, via direction arrows 204. The user will insert and fit the edges 126*a*, of removable puzzle element 102, into the edges 126, of the puzzle base 104.

Next, the paper liner 202, is pasted to the back side 108, of the wooden puzzle base 104, via direction arrows 206. It should be noted that the paper liner 202, will have the same shape cut through as the removable puzzle element 102. The shape of the paper liner will however be held in place by means of slit lines 216, shaped as the removable three-dimensional element 102, with small attachment points for keeping the shape 212, retained with the rest of the paper 220, until punched out by the user. When punched out, the base paper shape 220, will have the same perimeter shape opening 216, as the shape of the base paper puzzle element 104, and the removable puzzle element 102. There will be a base paper opening 214, like the opening 128, of the base element 104, but only the removable paper shape 218, will be able to fit with the opening 214, on the base paper 202.

The paper shape 218, can be punched out two ways. First, by first removing the wooden removable puzzle element 102, from the base puzzle element 104, and then put your fingers through the opening 128, from the front face 106, of the puzzle base element 104, via arrows 204 and 210, and through the opening 214, of the paper liner 220. The user will push gently, and the paper will come out. The second way is via a tab on the shape 212 itself. The tap can be lifted up from the base paper front 220, which is the back side 108, of the wooden board 146. When the paper shape 220, is punched out from the paper 202, and the removable puzzle element 102, is removed from the puzzle base element, a user can see an opening through the wooden puzzle base element 104, with similar perimeter as the removable three-dimensional puzzle element and the removable paper shape 212.

Figure 13:
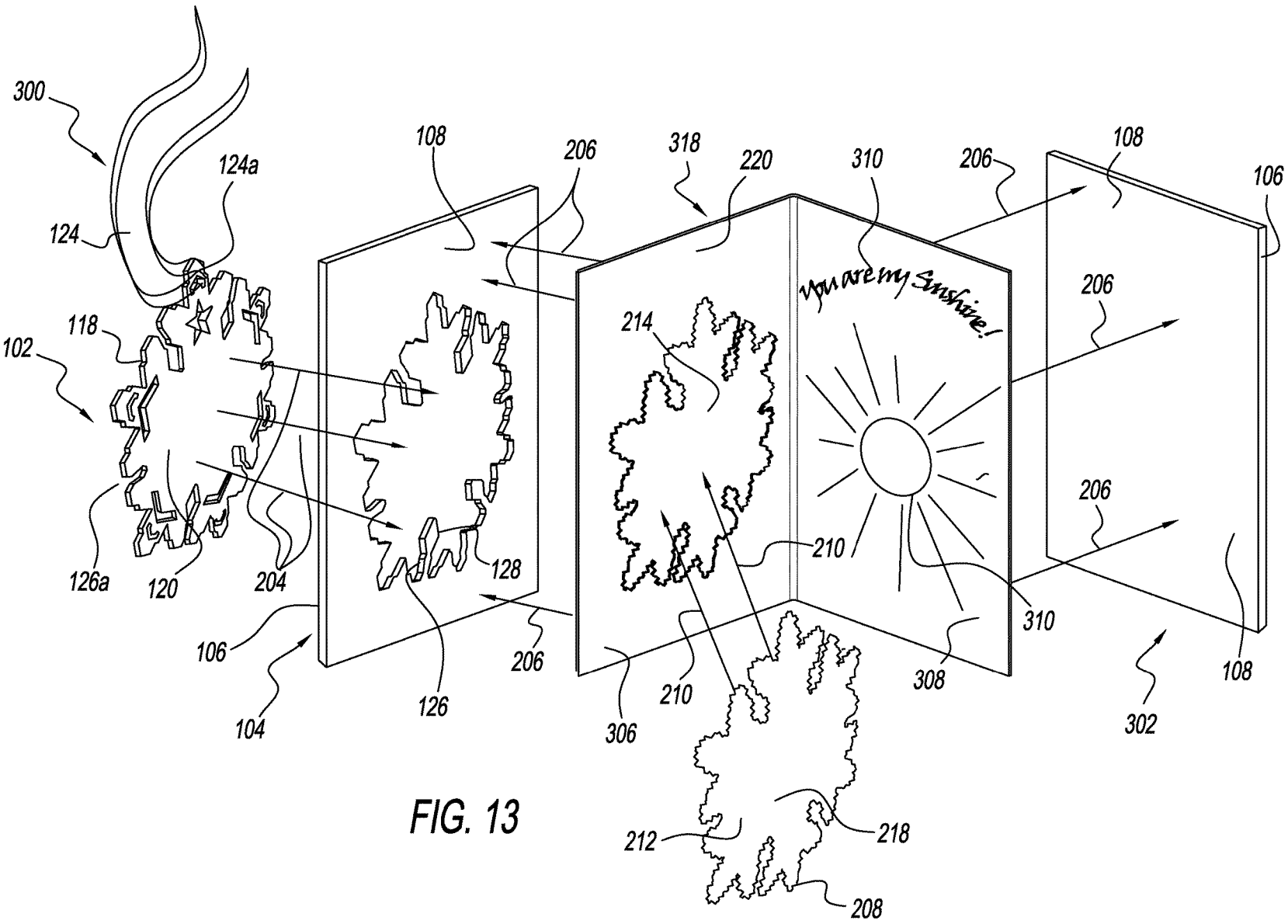
FIG. 13 is a perspective exploded view of the third embodiment of the multi-purpose three-dimensional puzzle system.
Figure 14:
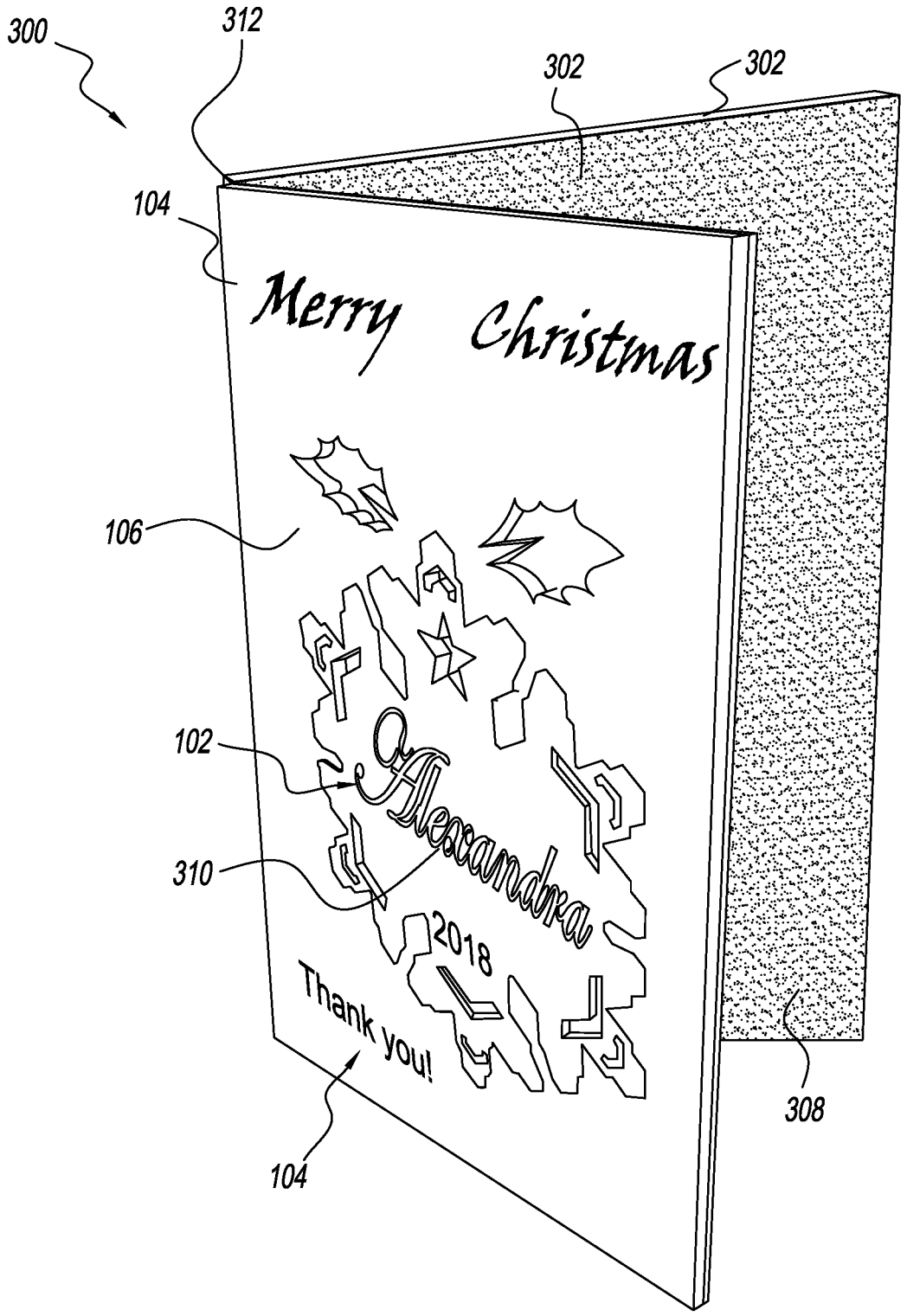
FIG. 14 is a perspective view of the third embodiment of the multi-purpose three-dimensional puzzle system fully assembled.
Figure 15:
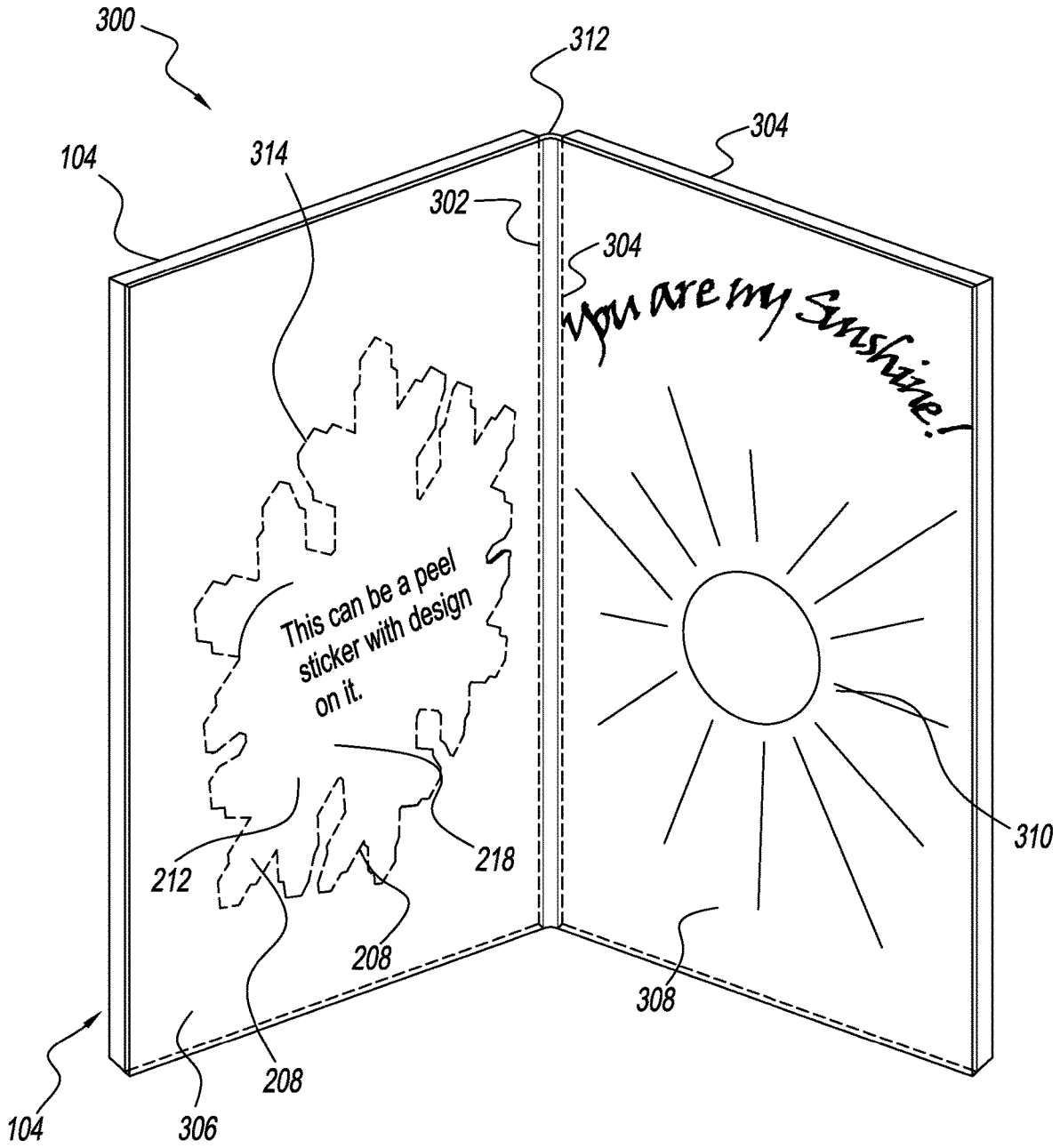
FIG. 15 is a perspective view of the third embodiment of the multi-purpose three-dimensional puzzle system fully assembled and open.
Figure 16:
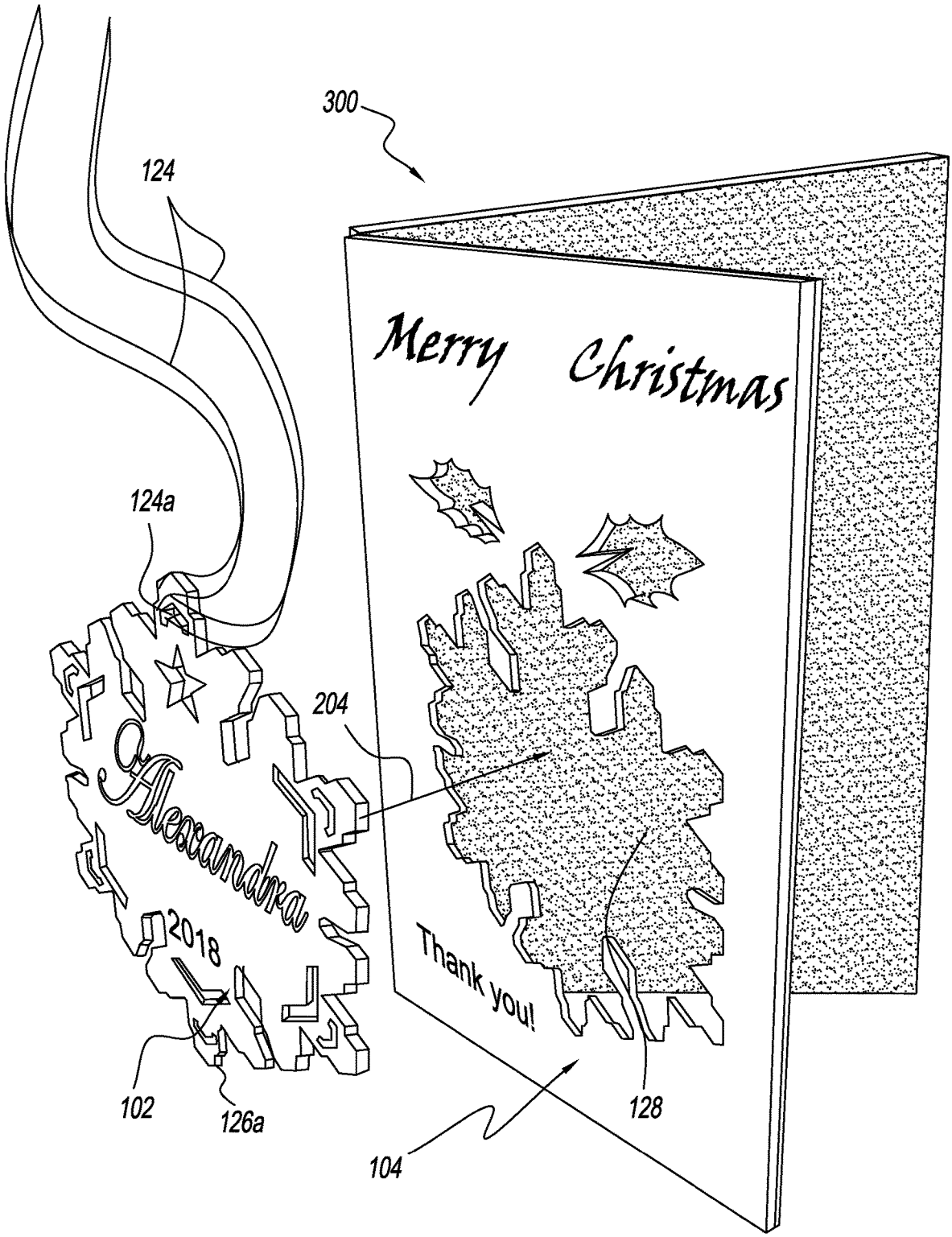
FIG. 16 is a perspective view of the third embodiment of the multi-purpose three-dimensional puzzle system with the remove puzzle element shown exploded from the base puzzle element.
Figure 17:
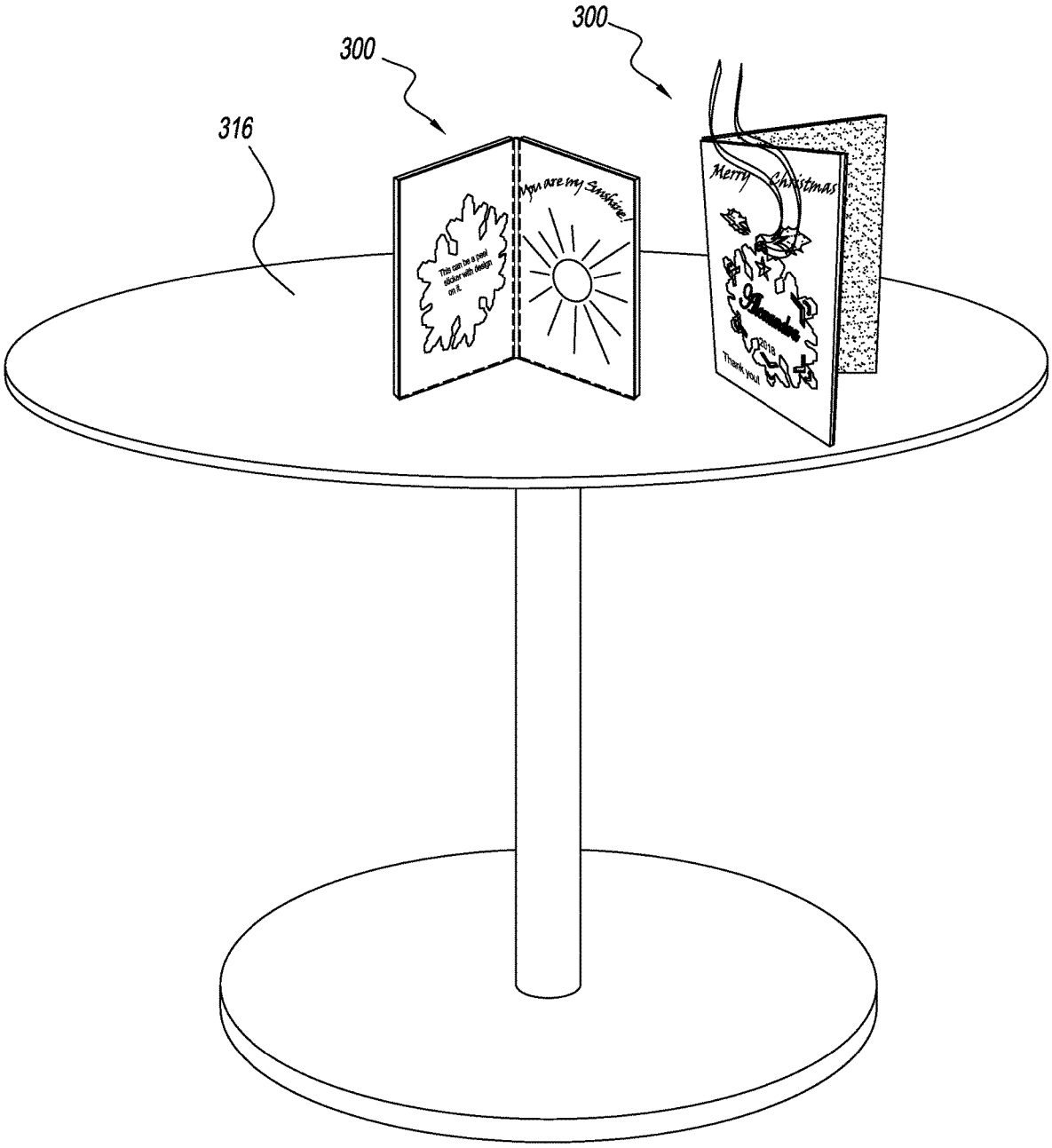
FIG. 17 is showing the third embodiment of the puzzle system in use on a table top.

FIG. 13 to FIG. 15 is showing an exploded view of the third embodiment 300, of the three-dimensional pairable puzzle system. This embodiment is like the preferred embodiment 100, in that it is consisting of a removable puzzle element 102, and a base puzzle element 104, which, when combined will form the pairable three-dimensional puzzle system with hanging element 100. Embodiment 300 will be a combination of the prefer embodiment 100, with an additional wooden panel 302, by means of a paper lining 318, to form a single piece 300. It should also be noted that the puzzle element is not limited to a single removable piece. The surface space on the wooden board 146, is large enough to carved out multiple puzzle elements of various shapes on one base element. A user can thus purchase a single card that can have multiple keepsakes puzzle elements.

Focusing now on FIG. 13, which shows the third embodiment 300, completely exploded. Here, we see the removable three-dimensional puzzle element 102, the puzzle element base 104, and the ribbon 124, inserted into the opening 124*a*, on the removable puzzle element 102. Identified also in FIG. 13 is the folded base element liner paper 218, and the removable paper shape 212.

As shown in FIG. 13, to assemble embodiment three, you first insert the removable puzzle element 102, into the opening 128, that is on the front 106, and back 108, of the pairable puzzle base element via direction arrows 204. The user will insert and fit element the edges of removable puzzle element edges into the edges 126, of the puzzle base 104. Next, the fully assembled folded paper base liner 318, is pasted to the back side 108, of the wooden puzzle base 104, and the second wooden panel 302, via direction arrows 206.

One panel of the paper 318, will be pasted to the puzzle system 100, and the other side of the base panel paper 318, will be pasted to the additional wooden panel 302, on the other side. It should be noted that the paper liner 302, will have the same shape cut through as the removable puzzle element 102. The shape of the paper liner will however be held in place by means of slit lines 216, shaped as the removable three-dimensional element 102, with small attachment points for keeping the shape retained with the rest of the paper until punched out by the user. When punched out, the base paper shape 220, will have the same perimeter shape 216, as the shape of the base puzzle element 204, and the removable puzzle element 102. There will be base paper opening 214, like the opening 128, of the base element 104, but only the removable paper shape 212, will be able to fit with the opening 214, on the base paper 202. When the folded paper liner 318, is attached to the two wooden panels 104, and 302, it creates fold 312, in the middle to open and close the puzzle like a wooden greeting card with removable puzzle element 300, or a back cover of a hardcover book.

Notice that the front surface 118, of the removable puzzle element 102, will have some graphics and design 310, on the surface 106, and as well as the inner fold where the paper liner 318, is located. FIGS. 14 and 15 is showing the third embodiment fully assembled and opened thus exposing the paper side. There, you can see the two wooden panels 104 and 304. Also seen is the paper liner 318, fully pasted and the fold line 312. Also seen is the serrated paper slit line 314, to punch out the paper shape 218. As shown in FIG. 14 and FIG. 15, this embodiment 300, is suitable for writing or drawing as the removable puzzle element can be fitted and removed. The additional wood makes possible for a writing surface 308, while also providing the puzzle surface 306. In addition, the additional wooden element could also have a puzzle cut through to provide two or more removable puzzle elements.

The structural design of the invention makes it possible to use the puzzle system in many ways. For example, the multi-purpose pairable puzzle system 100, wherein the base puzzle element 104, and the removable three-dimensional puzzle element 102, combined together can be use as a single gift item. As shown in FIG. 1, 2 and FIG. 5, a message can be written across surface 106 and 108. The message can be written in a way that that even with the removable puzzle element 102 is detached as in FIG. 6, the puzzle base element 104 will still carry the proper message.

The message can correspond with the two fitted puzzle that can serve as a trading card. While the surface of the card can be cut out and used as a puzzle block as in the case of 102, various design can be carved and etched into the card. Also, there can be a combination removable puzzle element shape and another relatable shape or plurality of shapes can be pasted or glue on the surface of a board with the puzzle element or without the puzzle element. The gift can be given to the receiver, but the receiver may not be aware of the usable puzzle function of the card. Having enjoyed the immediate benefit of the overall intricate design of the greeting card and gift thereof the user can later discover the puzzle element which thus enhance the value and usability of the card.

Text can also be etched into the card as well as design. The shape that can be cut out of the card is unlimited. Besides the example snowflake shape that makes element 102, various other shapes can be cut out to make the puzzle element. For example, the zodiac sign design can be cut to make a puzzle element or etched on the surface. Further, text such as braille can be stamped on the card to assist those who can read braille. The three-dimensional puzzle element or the entire card can be scented in fragrance oil or sprayed on its surface as aroma for a room or when worn as an ornament on the go. Also, the surface of the second embodiment can be hand-written on or hand drawn on to give a very personal touch. The multi-purpose three-dimensional puzzle system 100, can be made from wood material such as Balsa, Birch, Oak, Maple, Pine, Cedar, Poplar or a combination of wood type including fabricated wood or artificial wood material.

It should be noted and emphasized that the puzzle elements of the multi-purpose three-dimensional puzzle system is not limited to wood material. The design can also be made from using plastic, metal, paper, acrylic, glass or any material that those who are experience in the art of carving and etching will think fit to use. With added attention drawn to FIG. 7, the removable three-dimensional element 102 is not limited to the exact shape opening 128, that is cut into the base puzzle board 104, and if the shape is exactly the same fitted shape as is illustrated in the disclosed drawings of FIGS. 1 to 21, the various puzzle elements is not limited to the same material. For example, a wooden three-dimensional puzzle piece 102, could built to fit perfectly into the opening shape 128 of a metal puzzle base element 104.

Also, a removable metal three-dimensional puzzle element can be built to fit perfectly into a wooden three-dimensional puzzle base. The same can be stated for all other material that can be used to build the puzzle system. Further, as an example embodiment, the removable three-dimensional puzzle pieces 102 each made from different materials such as metal, plastic, glass, acrylic, paper can be design and shape to fit perfectly into the complementary opening 128, on a single three-dimensional puzzle base that is made 104, that is made from a wooden material.

Figure 18:
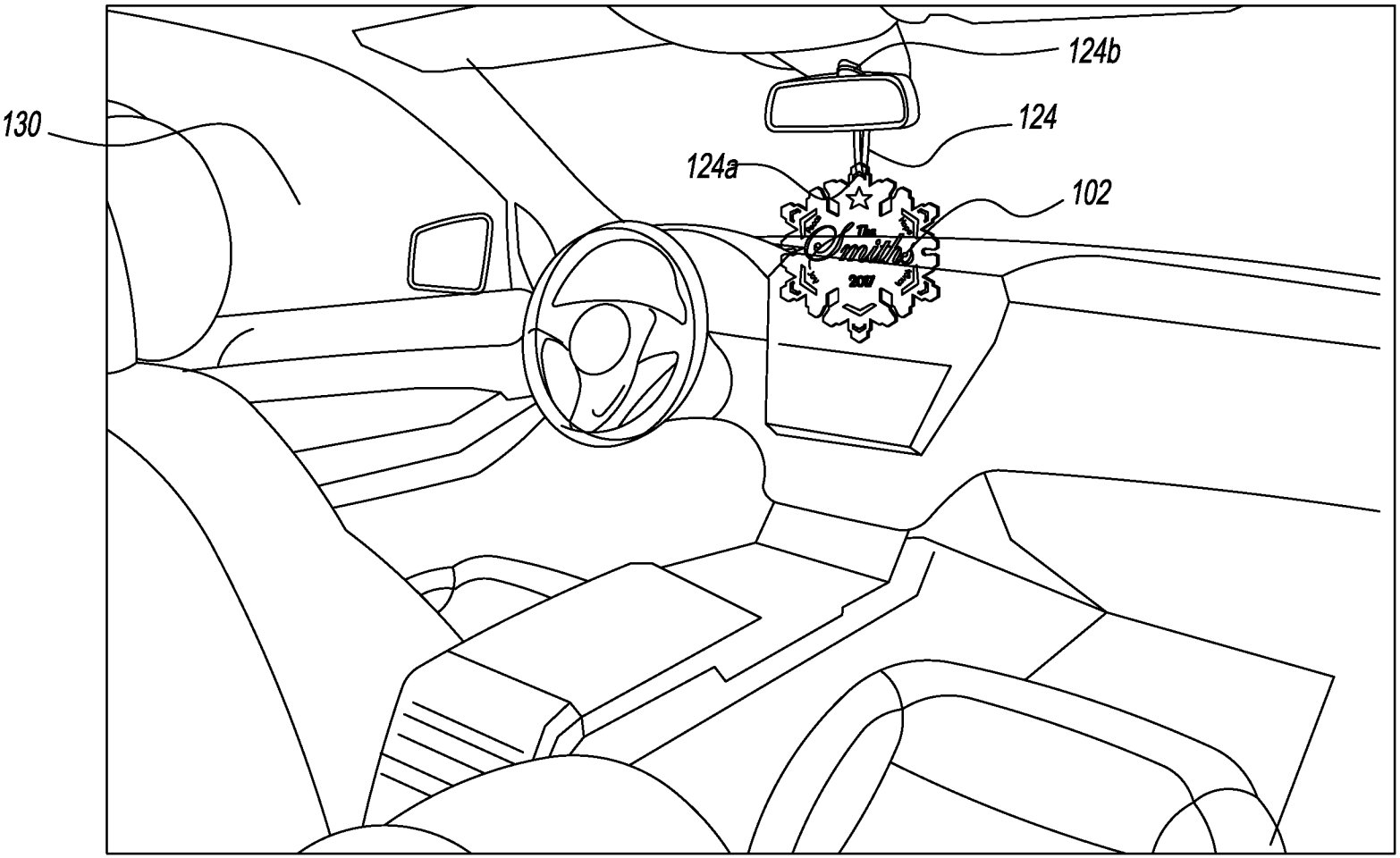
FIG. 18 is showing the three-dimensional removable puzzle element in use as a hanging element in a car or as an air freshener.

The puzzle system 100, can serve as a business card, greeting card or brand promotional item. It should be noted that the design or message is not limited to the design, shape or message shown in the drawing, however the method of assembling and the benefit of use remains the same. With continuous focus on FIG. 6, we see that the removable puzzle element is shown detached from the base element. When detached, the removable puzzle element and included ribbon can serve multiple purposes as the user sees fit such as hanging the product as an air freshener or in a car as shown in FIG. 18 or for as a fashion accessory to be worn around the neck or wrist as shown in FIG. 20.

Figure 19:
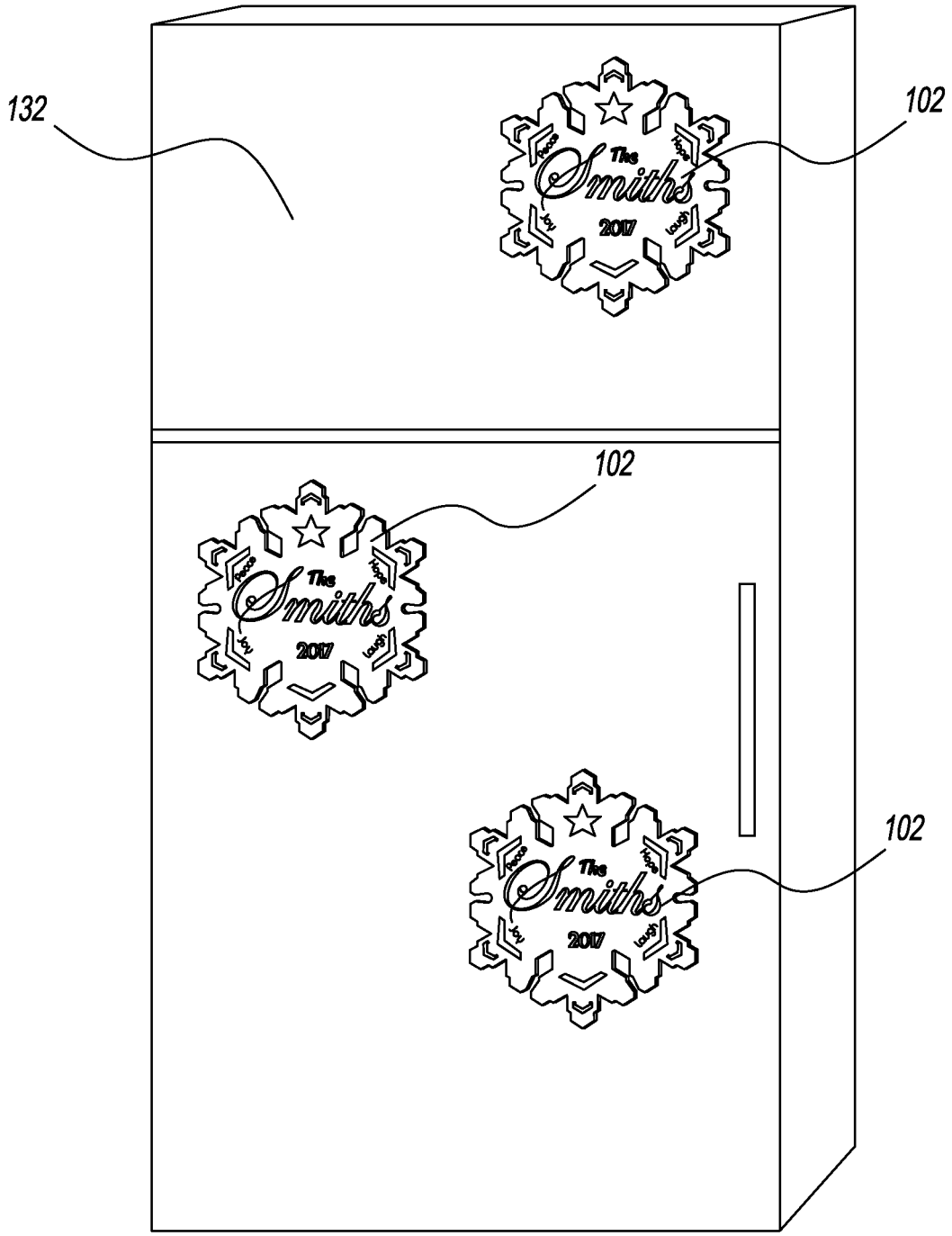
FIG. 19 is showing the three-dimensional removable puzzle element in use as a refrigerator magnet.
Figure 20:
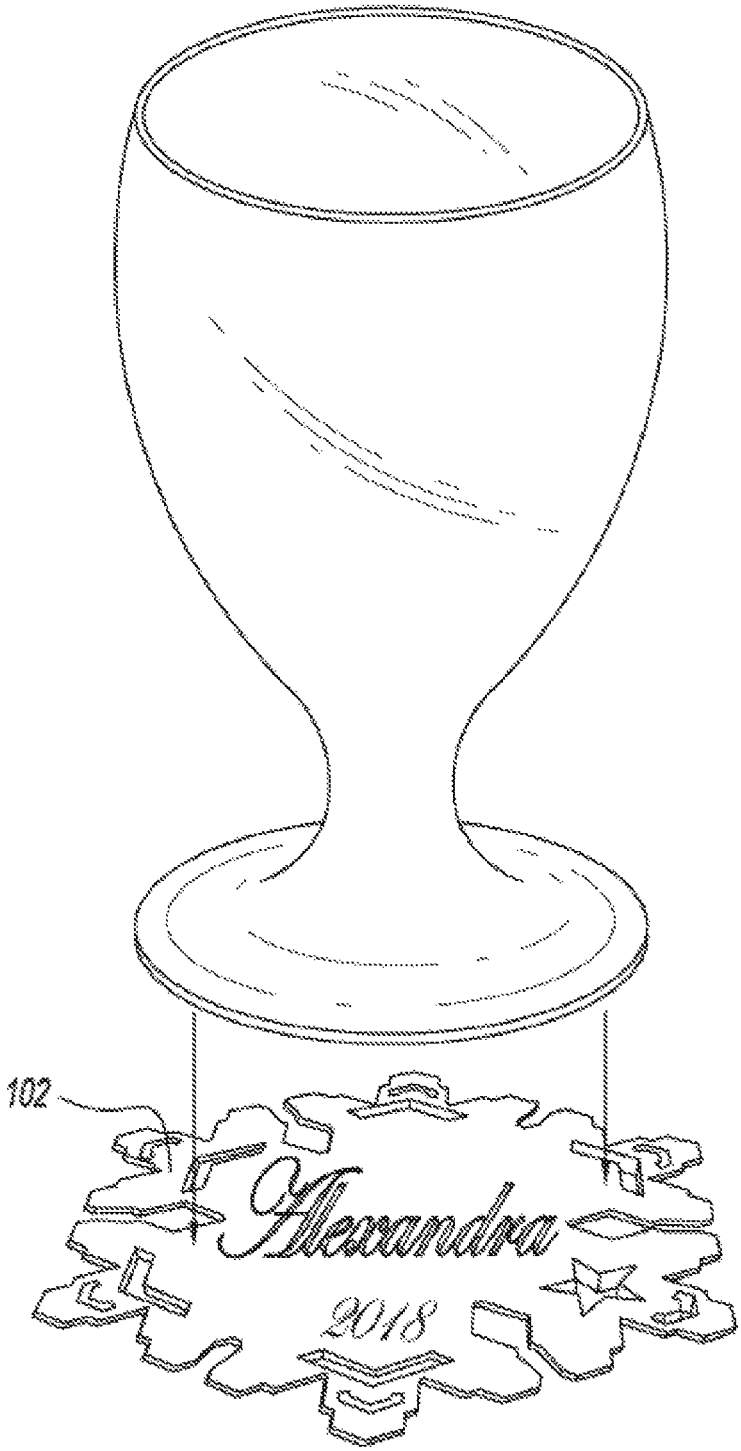
FIG. 20 is showing the three-dimensional removable puzzle element in use as a coaster.
Figure 21:
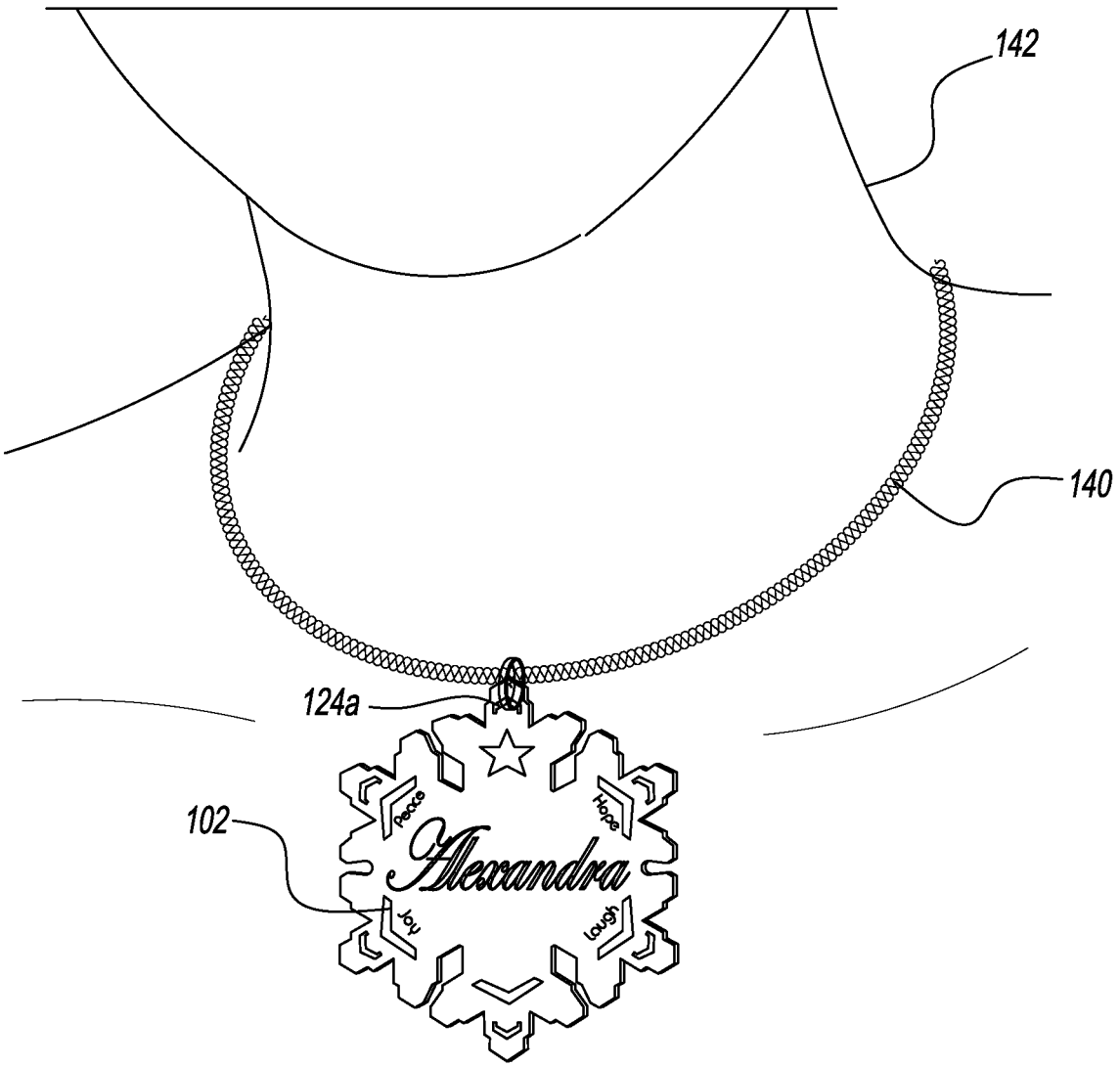
FIG. 21 is showing the three-dimensional removable puzzle element in use on a necklace.

The removable puzzle element 102 can also be used as a keepsake, an ornament, a keychain item, a toy or a holy item, a refrigerator magnet as shown in FIG. 19, a coaster as shown in FIG. 20, and attached to a necklace 140 in FIG. 21. Referring again to the second embodiment 200, and third embodiments 300, as illustrated and described in FIG. 10 to FIG. 16. The removable puzzle element 102, can be built in a way and attached to the base puzzle element 104 that the user 142 will not suspect that the puzzle element 102 is removable until he or she discovers the function or is instructed to do so. As shown in FIG. 10, the paper liner will serve as a writing, or graphic surface. The multi-purpose three-dimensional puzzle system is easy to make and very reasonable, but the benefit will serve as a lasting memory to both the giver and the user 142.

Various modifications of these embodiments will readily be apparent to those skilled in the art in view of the present disclosure, and genetic method defined herein may be applied to other embodiments.

All structural and functional equivalents to the elements of the various embodiment of the invention described throughout the disclosure that are known or later come to be known to those ordinarily skilled in the art are expressly incorporated herein by reference and intended to be encompassed by the invention.

The above description and drawings are only illustrative of the preferred embodiments which achieve the objectives, features and advantages of the present invention and it is not intended that the present invention be limited thereto. Any modification of the present invention which comes within the spirit and scope of the following claims is considered part of the present invention. Furthermore, to the extent that the terms "include", "have" or "like" is used in the description or the claims, such terms is intended to be inclusive in manners similar to the term "comprise" as interpreted when employed as a transitional word in the claim.

The invention claimed is:

1. A puzzle set comprising:

a base board;

a cut-out opening through the base board defined by a perimeter;

a removable puzzle element defined by an edge, the puzzle element complimentary to the cut-out opening of the base board such that the edge of the puzzle element lies flush against the perimeter of the opening when the puzzle element is inserted into the cut-out opening;

a paper element pasted flush against a back surface of the base board and extending across a back side of the cut-out opening and the paper element is not pasted to a back side of the removable puzzle element;

a removable region of the paper element defined by slit lines congruent with the edge of the puzzle element;

a ribbon extending through an opening in the puzzle element.

2. The puzzle set of claim 1 wherein said puzzle element has a plurality of openings to insert a ribbon for the purpose of hanging.

3. The puzzle set of claim 2 wherein said puzzle element is an air freshener.

4. The puzzle set of claim 2 wherein said puzzle element is a coaster.

5. The puzzle set of claim 2 wherein said puzzle element is a refrigerator magnet.

6. The puzzle set of claim 2 wherein said puzzle element is formed from a wood material selected from the group consisting of Balsa, Birch, Oak, Maple, Pine, Cedar, and Poplar.

7. The puzzle set of claim 2 wherein said ribbon is formed from a material selected from the group consisting of string, rope, yarn, strand, cord, twine, and wire.

8. The puzzle set of claim 1 further comprising a second wooden board having an area equal to an area of the base board, wherein the paper element includes a region which extends beyond the area of the base board, and the second wooden board is pasted to the region of the paper element extending beyond the base board; and wherein the wooden board is capable of being folded flush against the base board.

* * * * *